United States Patent [19]

Smith

[11] Patent Number: 4,909,506

[45] Date of Patent: Mar. 20, 1990

[54] EXERCISE DEVICE

[76] Inventor: Honey L. Smith, 401 Laurel Ave., No. C1, Pinole, Calif. 94564

[21] Appl. No.: 241,149

[22] Filed: Sep. 7, 1988

[51] Int. Cl.[4] ..... A63B 21/02

[52] U.S. Cl. ..... 272/139; 272/137

[58] Field of Search ..... 272/67, 68, 135–143

[56] References Cited

U.S. PATENT DOCUMENTS

| | | | |
|---|---|---|---|
| 1,669,499 | 5/1928 | Titus | 272/137 |
| 2,106,994 | 2/1938 | Chapman | 272/137 |
| 2,714,008 | 7/1955 | Urban | 272/137 |
| 3,451,675 | 6/1969 | Burzienski | 272/137 |
| 3,659,846 | 5/1972 | Kanicki | 272/142 X |
| 3,768,808 | 10/1973 | Passera | 272/142 X |
| 4,022,463 | 5/1977 | Scott, Jr. | 272/142 X |
| 4,273,328 | 6/1981 | Ozbey et al. | 272/143 X |
| 4,350,335 | 9/1982 | Pasbrig | 272/141 X |
| 4,376,533 | 3/1983 | Koibel | 272/137 |
| 4,489,937 | 12/1984 | Kong | 272/142 X |
| 4,775,148 | 10/1988 | McLaughlin | 272/135 X |

FOREIGN PATENT DOCUMENTS

| | | | |
|---|---|---|---|
| 1012574 | 6/1977 | Canada | 272/137 |
| 12929 | 9/1987 | United Kingdom | 272/141 |

*Primary Examiner*—Richard J. Apley
*Assistant Examiner*—Robert W. Bahr
*Attorney, Agent, or Firm*—Bielen, Peterson & Lampe

[57] ABSTRACT

An exercise device that is light in weight and designed in particular to exercise the thighs, the device having a pair of opposed curved brace members, which are interconnected by two still coil springs, the brace members having straps for fastening the brace members against the inner thighs of a user. The exercise device is designed for other different exercises and is easily taken with the user during travel.

4 Claims, 1 Drawing Sheet

EXERCISE DEVICE

BACKGROUND OF THE INVENTION

This invention relates to a compact device for performing a plurality of different exercises. The device is inexpensive, simple to use and is both light in weight and compact in size to enable the device to be taken with the user in his or her travels.

The benefits of frequent exercise have been well publicized. Unfortunately, many people are unwilling to engage in the formal exercise programs that can be so helpful. For such people, exercise must be frequently conducted at home or wherever opportunity permits. While many innovative and modern mechanisms have replaced or supplemented programs utilizing weights as the preferred form of muscle toning, such equipment is often extremely expensive and requires a substantial area for its fixed location. While exercise for much of the body can be accomplished without the use of specialized equipment, certain parts of the body respond well to specialize implements design to target select muscles.

One area of particular concern is the inner and outer thigh. Most normal exercises do not adequately target these areas. Customarily, expensive equipment designed to seat an individual with knees clamped in specially constructed arms for resisting the opening and closing of the legs are used. Exercised with such devices develop the muscles that are frequently used during horseback riding when clamping the knees against the saddle and horse. Frequent, exercise of this area leads to the trim appearance desired by many men and women. The large and expensive equipment designed for exercising this area of the body is generally not available outside specialty fitness centers.

Preferably, however, a device that is designed to exercise this area should be useable at home and have utility for exercise of other areas. The exercise device of this invention is designed to be used in several selected exercises and is adaptable to many others. It is light in weight, compact and can be used in the privacy of the home or taken with the user wherever he or she travels.

SUMMARY OF THE INVENTION SUMMARY

This invention relates to an exercise device that is light in weight and compact. The exercise device is constructed with two curved brace members interconnected by a pair of coil springs. The curved or arcuate brace members have distal ends with a slot for engagement of a strap. The brace members are padded to provide a cushion for the user's body parts when applying a force against the brace members for compression of the coil springs.

The exercise device is particularly designed for use in strengthening the thighs, and the arcuate brace members are designed to engage the leg above the knee while the user is seated. The straps are fastened around the leg to support and retain the exercise device during use. When the user attempts to clamp the knees together, the coil spring are compressed resisting the opposed clamping force. The use of at least two coil springs to interconnect the two curved brace members provides a stability to the structure and prevents the device from twisting. In the preferred embodiment, the coil springs each have a different spring constant such that the effective resistance for certain exercises can be varied.

For example, when the exercise device is used to strengthen the arms and chest, the distal ends of opposed arcuate brace members are grasped in the user's hands and the user attempts to force his hands together. Depending on which of the opposed distal ends are grasped, the effective resistance is substantially different. These and other features will become apparent from a consideration of a detailed description of the preferred embodiment.

DETAILED DESCRIPTION OF THE PREFERRED EMBODIMENTS

Figure 1:
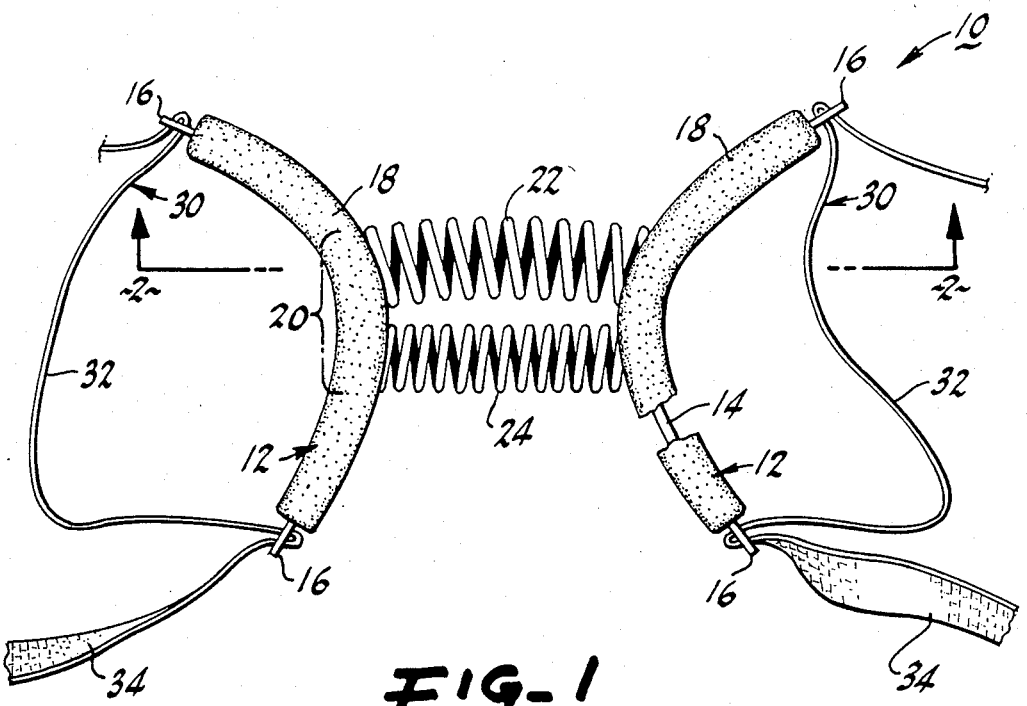
FIG. 1 is a perspective view of the exercise device.
Figure 2:
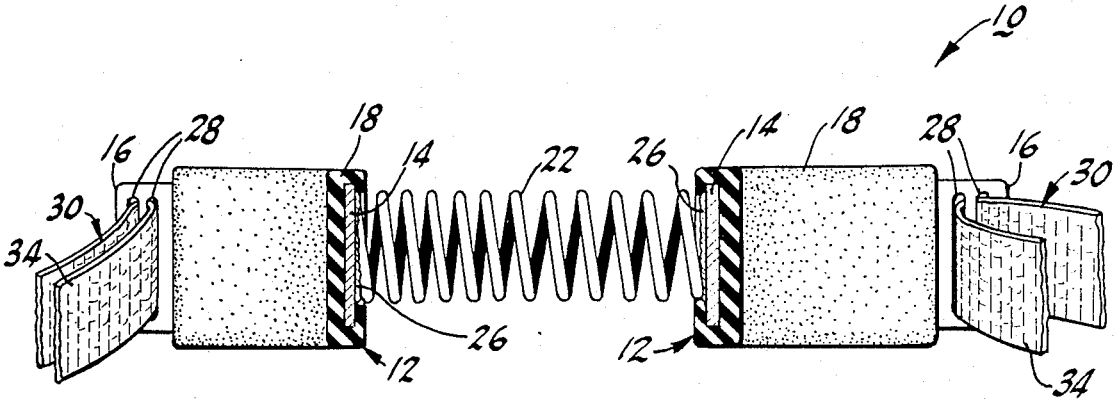
FIG. 2 is a cross sectional view taken on the lines 2—2 in FIG 1.

Referring to FIG. 1, the exercise device of this invention is designated generally by the reference numeral 10. The exercise device 10 is constructed with a pair of opposed brace members 12 which are fabricated from a flat steel band 14 which is formed into an arcuate or curved configuration with exposed distal ends 16. The remainder of the band 14 is covered with a padding 18 such as a dense, closed-cell foam material commonly used with exercise equipment for providing a cushioned contact surface. Proximate the center portion 20 o the band there are connected two coil spring 22 and 24. As shown in FIG. 2, the coil spring, here spring 22, is connected to the band at its end 26 by welding or other means that permits the coil spring to be placed in tension or compression. The welded end 26 of the coil spring 22 is covered by the padding material 18 for sake of appearance. The coil springs 22 and 24, as shown in FIG. 1, interconnect the two brace members 12 which are arranged such that the ends 16 are outwardly facing in the manner of typical hyperboles.

The exposed ends 16 of the steel band 14 each have a pair of closely spaced slots 28 through which is laced a woven nylon strap 30 for each of the two brace members 12. Each of the two straps 30 is laced through the opposed ends 16 of each band 14 and is of a length that enables the brace members 12 to engage each of a user's inner thighs with the interconnecting portion 32 of the strap encircling the user's outer thigh. The end portions 34 of the straps 30 can be pulled to tighten the strap around the user's thigh. In this manner, while conducting leg exercises, the exercise device 10 will not become dislodged as the user separates and brings together his or her knees while seated with the exercise device placed with the brace members against the inner thighs just above the knee.

Because the springs are able to both compress and expand, the exercises performed with the device are dynamic rather than isometric. Many of the exercises performable with the exercises device, are similar in form to isometric exercises. For example, when the user grasps the brace members with his hands positioned approximate the ends of opposed members and presses the ends toward one another, the user performs an exercise similar to the isometric exercise of pressing palms together. This exercise strengthens the shoulders, arms and chest and has the added advantage of being dynamic.

In the preferred embodiments, the coil springs 22 and 24 are of different spring constant to provide different resistance to compression or expansion. Generally, the spring should be of sufficient stiffness to provide a 75% compression when 20–30 lbs of pressure are applied to the brace members. Certainly, for more advanced users coil springs with greater stiffness can be utilized. A difference of 5–10 lbs in the total in 75% compression between each of the springs allows, for example, the chest exercise to be performed at different levels of resistance depending on which ends of the brace members 12 are grasped.

While two exercises have been described as examples of the use of the exercise device, other exercises can be devised to fully utilize the benefits of this compact exercise device. Because the exercise device is relatively small and light in weight it can be carried with the user during his or her travels. Because coil spring are utilized to provide the resisting forces, bulky and heavy weights are avoided. Furthermore, the unique construction of the exercise device allows the device to be used for certain exercises for which conventional weights are unsuitable.

While in the foregoing embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. An exercise device comprising:

first and second curved brace members, each brace member constructed with a rigid arcuate band having terminal ends;

coil spring means for interconnecting the brace members, and maintaining the brace members in their relative position, the coil spring means including first and second straight helical coil springs with opposite ends, wherein the springs are arranged substantially parallel to one another and the curved brace members are located at the opposite ends of the coil springs with the terminal ends of the first and second brace members being directed away from the spring means, and wherein said first and second helical coil springs are characterized by being operable in both compression and tension and by being relatively stiff such that the brace members maintain their relative position with one another until external forces applied to the brace members deforms the springs; and first and second strap means for securing the brace members to a user during exercise, wherein the terminal ends of each brace member have means for securing one of said strap means to each brace member.

2. The exercise device of claim 1 wherein the helical coil springs each have a different spring constant.

3. The exercise device of claim 1 wherein the arcuate bands, excepting the terminal ends, are covered with a cushioned material.

4. The exercise device of claim 1 wherein the securing means at the terminal ends of the bands comprise a pair of closely spaced slots through which the strap means are laced.

* * * * *